US005311760A

United States Patent [19]

Thompson

[11] Patent Number: 5,311,760

[45] Date of Patent: May 17, 1994

[54] METHOD AND APPARATUS FOR CORNER BEAD ANGLE ENLARGEMENT

[76] Inventor: Matthew H. Thompson, 1217 Sheridan Rd., Apt. 1, Withrop Harbor, Ill. 60096

[21] Appl. No.: 924,832

[22] Filed: Aug. 4, 1992

[51] Int. Cl.[5] ..... B21D 5/06; B21D 5/16

[52] U.S. Cl. ..... 72/176; 72/387; 72/379.2; 493/409; 493/439

[58] Field of Search ..... 72/176, 387, 379.2, 72/457, 412; 493/409, 439, 456, 457

[56] References Cited

U.S. PATENT DOCUMENTS

| | | | |
|---|---|---|---|
| 2,701,001 | 2/1955 | James | 72/387 |
| 3,583,199 | 6/1971 | Speiser | 72/387 |
| 4,643,016 | 2/1987 | Barberine | 72/387 |
| 4,848,126 | 7/1989 | Fryfogle | 72/176 |

FOREIGN PATENT DOCUMENTS

| | | | |
|---|---|---|---|
| 2423279 | 12/1974 | Fed. Rep. of Germany | 72/307 |
| 217114 | 8/1990 | Japan | 72/387 |

*Primary Examiner*—Daniel C. Crane

[57] ABSTRACT

This invention relates to a drywall corner bead spreading tool. It is a portable handheld device for quickly and easily increasing the included angle between the corner bead wings from 90° to 135° safely without bending or kinking. Corner bead splicing can now be eliminated in construction situations requiring the larger included angle and 10 feet ceiling height lengths. The device taught by this invention is simple to use and can be made nearly indestructible using 14 gauge steel.

14 Claims, 1 Drawing Sheet

FIG. 3
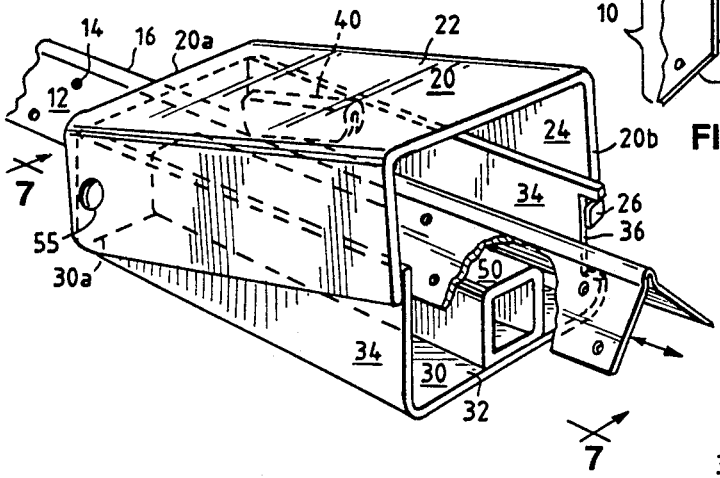
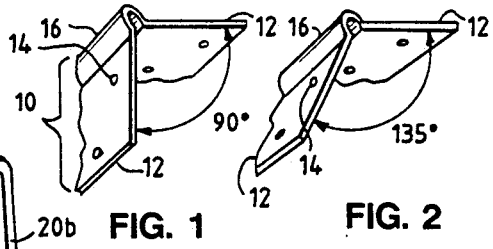
FIG. 1 FIG. 2
FIG. 5
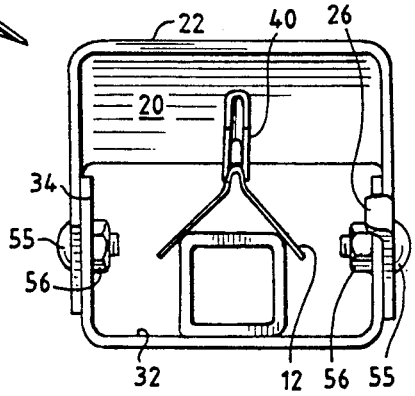
FIG. 4
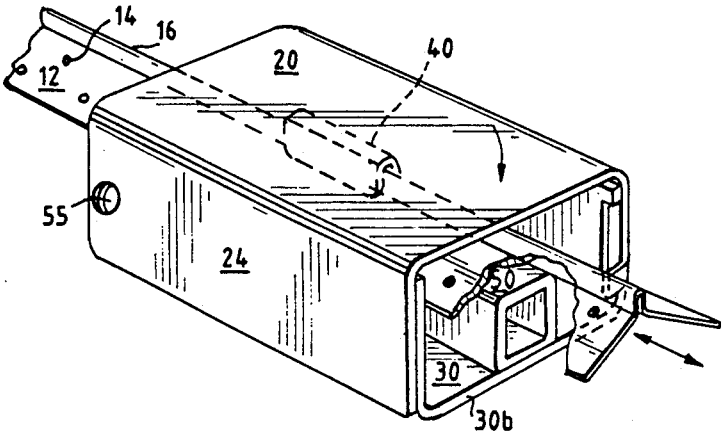
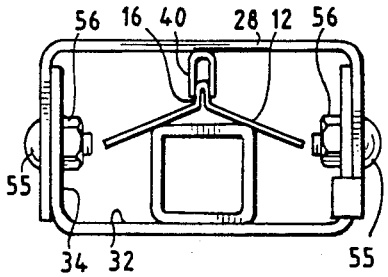
FIG. 6
FIG. 7
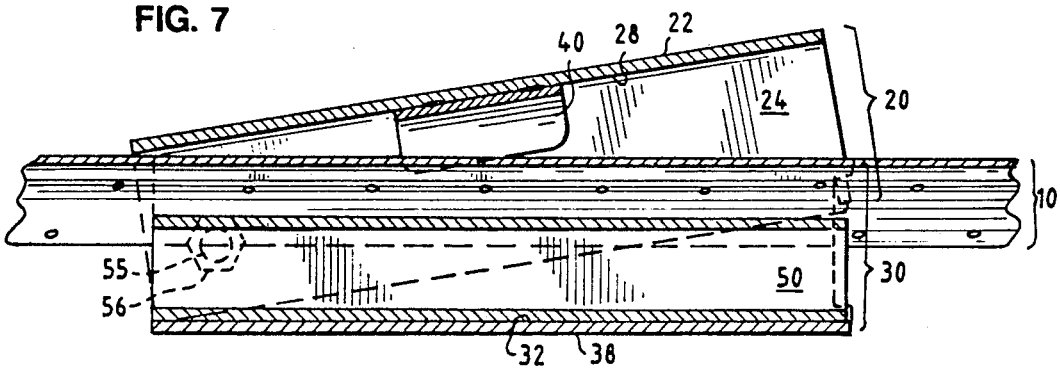

METHOD AND APPARATUS FOR CORNER BEAD ANGLE ENLARGEMENT

BACKGROUND OF THE INVENTION

Wallboard is the material of choice in the construction and renovation of homes and buildings today. Wallboard is prefabricated in sections and shipped to construction sites where it is joined together to form interior walls and partitions. Corner bead is used to bind edges of wallboard together at outwardly projected corners. The corner bead, a pre-made metallic beading, is sold commercially in lengths of 8 and 10 feet with an included angle of 90° and lengths of 10 feet with an included angle of 135°. Integral with the bead of the corner bead are a pair of wings extending the length of the bead and generally forming an included 90° angle therebetween. Each of the Wings is provided with a plurality of pre-punched holes extending along the entire length. The purpose of these holes is to permit finishing compound to flow therein once the corner bead is installed to an outer corner by nailing.

The corner bead is generally made with an included angle of 90° between the two outwardly extending wings which is appropriate for a standard 90°outside corner. However, many architectural plans require a wall with an excluded angle of 225° requiring a corner bead with wings having an included angle of 135° and complementary corners having included angles of 135°.

As a result of the need for dry wall corner bead having an included angle of 135°, wallboard installers have resorted to various means of increasing the included angle between corner bead wings. For example, a crude practice is to place a length of corner bead on a cement floor with the wings facing upwardly and then by using a hammer between the wings increasing the angle therebetween. As a result of this and other methods which are employed, the corner bead becomes badly bent and kinked and subjecting the installer to potential injury from the unbound wing edges.

In construction situations requiring the larger included angle corner bead and having ceiling heights of 10 feet, the 135° corner bead must be spliced together since it is available only in lengths of 8 feet. The instant invention however will allow commercially available lengths of 10'-90° corner bead to be used without splicing once it has been modified with the apparatus taught by this invention.

A stationary device which increases the angle between the extended wings of a corner bead is shown in U.S. Pat. No. 4,848,126, comprising a stationary support having a V-groove for positioning the bead and movable pressure applying spreading means, in the shape of a ball supported by an axle rotatably secured to a yoke which is movable perpendicular to the length of the corner bead for varying the angle of the wings. The principal disadvantages are that the device is stationary—its design limits it use to a fixed location at a construction site, it is not easily used as it requires several adjustments and cannot be operated quickly.

ADVANTAGES OF THIS INVENTION

The invention relates to a dry wall corner bead spreading tool—a portable handheld tool for increasing the included angle between two relatively disposed wings of an elongated article having a longitudinal apex, such as a corner bead. Unlike the prior art, the instant invention can be moved about a construction site to a location where the wallboard is being installed and there be available to modify the standard 90° wings of the corner bead to such angle as may be required for the particular application.

The invention is simple to use. The outer surface of the invention is unobstructed and easily handheld. The two outer members are pivotally connected and are easily raised to receive a leading end of the corner bead and with a portion of the corner bead positioned within the tool, the outer members are easily lowered to engage the corner bead which may then be moved through the tool, or, alternatively, with a portion of the leading end of the corner bead having at least one hole disposed on a wing thereof positioned to be exposed from the tool, one of the exposed holes of a wing can be secured to an extraneous stationary hook and the tool may be moved along the corner bead length, to quickly and easily increase the included angle between the wings of a length of corner bead safely without bending or kinking. The invention can be made nearly indestructible using 14 gauge steel.

SUMMARY OF THE INVENTION

The invention relates to a portable hand tool for increasing the included angle between two relatively disposed wings of an elongated article having a longitudinal apex, such as a corner bead.

The invention comprises first and second outer members, each having an upper and a lower surface and a forward end in opposition longitudinally to a remote end. The first outer member is arranged and adapted to have its lower surface facing the upper surface of the second outer member. The first outer member has a guide means centrally disposed longitudinally along its lower surface and the second outer member has a spreader means centrally disposed longitudinally along its upper surface.

The first outer member has a forward end pivotally connected to a forward end of the second outer member for movement between a raised position to a lowered position. In the raised position the distance between the guide means and the spreader means permits easy reception of a leading end of an elongated corner bead. In the lowered position, the lower surface of the first outer member is substantially parallel to the upper surface of the second outer member and the guide means slidably engage a longitudinal portion of the apex of the article while the spreader means transversely slidably engage a longitudinal section of each of the disposed wings of the corner bead along the wing surfaces that border the included angle between the wings at a spaced distance from the apex. The included angle between the wings of the corner bead is increased by the introduction of a leading end of an article longitudinally through an end opening of the outer members in a raised position between the guide means and the spreader means, by movement of the outer members from a raised position to a lowered position, and by relative longitudinally movement of the article and of the tool.

BRIEF DESCRIPTION OF THE DRAWING

Preferred embodiments of the invention are described hereinafter with reference to the accompanying drawing wherein:

FIG. 1 is a perspective view of an end piece of corner bead having a longitudinal apex and an included angle of 90° between its two relatively disposed wings and a plurality of holes on said wings;

FIG. 2 is a perspective view of an end piece of corner bead having a longitudinal apex and an included angle of 135° between its two relatively disposed wings and a plurality of holes on said wings;

FIG. 3 is a perspective view of a preferred embodiment of the portable hand tool for corner bead angle enlargement having its outer members in a raised position and showing an end segment of corner bead (partially cut away to show an end segment of the spreader means) which has been introduced longitudinally through an end opening of the outer members of the tool between the guide means (shown in phantom) and the spreader means which is partially shown (the double arrow is provided to show that the corner bead, after being introduced from either end of the tool, can be worked in either direction);

FIG. 4 is a perspective view of a preferred embodiment of the portable hand tool for corner bead angle enlargement having its outer members in a lowered position and showing an end segment of corner bead (partially cut away to show an end segment of the spreader means) which has been introduced longitudinally through an end opening of the outer members of the tool between the guide means (shown in phantom) and the spreader means which is partially shown (the double arrow is provided to show that the corner bead, after being introduced from either end of the tool, can be worked in either direction);

FIG. 5 is an end elevation view of the portable hand tool for corner bead angle enlargement of FIG. 3 of the present invention taken along its non-pivoted remote end, showing a guide means centrally disposed longitudinally along the lower surface of the first outer member and a spreader means centrally disposed longitudinally along the upper surface of the second outer member and showing an unadjusted 90° corner bead positioned therebetween;

FIG. 6 is an end elevation view of the portable hand tool for corner bead angle enlargement of FIG. 4 of the present invention taken along its non-pivoted remote end, showing a guide means centrally disposed longitudinally along the lower surface of the first outer member and a spreader means centrally disposed longitudinally along the upper surface of the second outer member, and in which the lower surface of the first outer member is substantially parallel to the upper surface of the second outer member, and showing the increased included 135° angle between the wings of a corner bead positioned therebetween; and FIG. 7 is a side elevation view of the portable hand tool for corner bead angle enlargement of the present invention taken along the line 7—7 of FIG. 3 showing the distance between the guide means and the spreader means which permits easy reception of a corner bead.

DETAILED DESCRIPTION OF THE INVENTION

The invention relates to a method and an apparatus for corner bead angle enlargement. As shown in FIG. 1, the corner bead 10 is comprised of an elongated apex (or bead) 16 having two relatively disposed wings 12 and a plurality of holes 14. Typical commercially available corner bead 10 has an included angle of 90° between the wings. Often an increased included angle is required at the construction site.

The instant invention teaches methods of increasing the included angle between the two relatively disposed wings of an elongated article having a longitudinal apex, such as a corner bead, which comprising the following steps:

a. arranging pivotally1connected first and second outer members, said first outer member, having an upper and a lower surface, with a guide means centrally disposed longitudinally on said lower surface, and having a forward end in opposition longitudinally to a remote end which is pivotally connected to the second outer member, said second outer member having an upper and a lower surface, with a spreader means centrally disposed longitudinally on said upper surface, and having a forward end in opposition longitudinally to a remote end which is pivotally connected to the first outer member, to have the lower surface of the first outer member facing the upper surface of the second outer member;

b. raising the forward end of the first outer member pivotally relative to the forward end of the second outer member to a distance between the guide means and the spreader means which permits easy reception of the article;

c. introducing a leading end of the article longitudinally through an end opening of the outer members between the guide means and the spreader means;

d. lowering the forward end of the first outer member pivotally relative to the forward end of the second outer member to permit the guide means to slidably engage a longitudinal portion of the apex of the article and the spreader means to transversely slidably engage a longitudinal section of each of the disposed wings of said article along the surfaces thereof bordering the included angle between said wings at a spaced distance from the apex, e. moving the article slidably through the guide means and the spreader means longitudinally, or alternatively, moving slidably the outer members longitudinally along the length of said article to increase the included angle between the wings of the article.

Without departing from the generality of the invention disclosed herein and without limiting the scope of the invention, the discussion that follows, will refer to the invention as depicted in the drawing.

The preferred embodiments of the apparatus depicted in the drawing comprise a portable hand tool for increasing the included angle between two relatively disposed wings of an elongated article having a longitudinal apex, such as a corner bead, comprising a first outer member 20 and a second outer member 30, a guide means 40, a spreader means 50, pivot means depicted in the drawing as two nut 56 and bolt 55 combinations and a stopping means depicted in the drawing as a projection 26 on the first outer member 20 and a corresponding recess 36 on the second outer member 30.

The first outer member 20 has an upper 22 and a lower surface 28 and a forward end **20*a* in opposition longitudinally to a remote end 20*b* and the second outer member 30 having an upper 32 and a lower surface 38 and a forward end 30*a* in opposition longitudinally to a remote end 30*b*. The first outer member 20 is arranged and adapted to have its lower surface 28 facing the upper surface 32 of the second outer member 30. The apparatus further comprises guide means 40 centrally disposed longitudinally along the lower surface 28 of the first outer member 20 and spreader means 50 centrally disposed longitudinally along the upper surface 32 of the second outer member 30**.

The forward end 20*a* of the first outer member 20 is pivotally connected to the forward end 30*a* of the second outer member 30 for movement between a raised position, as shown in FIGS. 3, 5 and 7, in which the distance between the guide means 40 and the spreader means 50 permits easy reception of a leading end of the corner bead 10, to a lowered position, as shown in FIGS. 4 and 6, in which the lower surface 28 of the first outer member 20 is substantially parallel to the upper surface 32 of the second outer member 30, and in which therebetween the guide means 40 may slidably engage a longitudinal portion of the apex 16 of the corner bead 10 in opposition to the spreader means 50 which is arranged and adapted to transversely slidably engage a longitudinal section of each of the disposed wings 12 of said corner bead 10 along the surfaces thereof bordering the included angle between said wings at a spaced distance from the apex 16, whereby, the included angle between the wings 12 of a longitudinal section of the corner bead 10 may be increased by the introduction of a leading end of the corner bead 10 longitudinally through an end opening of the outer members (20 and 30, respectively) in a raised position between the guide means 40 and the spreader means 50, by movement of the outer members from a raised position to a lowered position. The length of said corner bead 10 may likewise be affected by relative movement of the corner bead 10 slidably passing through said apparatus longitudinally and of the apparatus slidably passing along the length of the corner bead 10.

As shown in FIG. 3, the second outer member 30 is generally a U-shaped channel with two side walls 34 extending upwardly from the upper surface 32 of the second outer member 30 and with end openings, that is, with no side walls upwardly extending at either end, and with side wall height which exceeds the height of a corner bead 10 positioned with its apex 16 upwardly directed, and with a width which exceeds the widest width of wing span of the corner bead 10 and having a length proportioned to receive a longitudinal section of the corner bead 10.

As further shown in FIG. 3, the first outer member 20 is generally a U-shaped channel with two side walls 24 extending downwardly from the lower surface 28 thereof, and with end openings, and with a width which exceeds the width of the second outer member 30 and with a length proportioned to receive the second outer member 30.

The second outer member 30 may be arranged and adapted to be substantially nested within the first outer member 20, in which the forward end 20*a* thereof is pivotally connected to a forward end 30*a* of the second outer member 30.

The guide means 40, as best shown in FIGS. 4 and 7, is generally a U-shaped channel having an upper surface 41 and a lower surface 43 and two side walls 45 extending downwardly from the lower surface 43 and having end openings, and having a width which exceeds the width of the apex 16 of the corner bead 10, and having a height of its downwardly extending side walls 45 which does not exceed the height of the apex 16 of the corner bead 10, and having a length which does not exceed the length of the first outer member 20.

The spreader means 50 is generally an elongated projection having a width not exceeding the wing span of corner bead 10 having an included angle of 90°, and having a height not exceeding the height of the side walls 34 of the second outer member 30 less the height of the apex 16 of the corner bead 10 and proportioned to transversely engage and displace the disposed wings 12 of the corner bead 10 when the first outer member 20 and the second outer member 30 are moved to a lowered position, as shown in FIGS. 4 and 6.

The spreader means 50 may comprise a downwardly opening U-shaped channel, or it may comprise a rectangular tube, i.e. a hollow rectangular parallelepiped, as shown in FIG. 3.

Referring to FIG. 3, a stopping means, to limit the movement of the remote end 20*b* of the first outer member 20 relative to the remote end 30*b* of the second outer member 30 is shown. The stopping means comprises an inward projection 26 extending from an inner surface of a side wall 24 of the first outer member 20 proximate to the remote end 20*b* thereof arranged and adapted to move within a recess 36 in an adjacent side wall 34 of the second outer member 30 as said members (20 and 30, respectively) are moved between a raised and a lowered position.

Depending on the choice of materials, certain rigidly flexible plastics, such as polypropylene or materials having like flexibility, could provide for integral outer members having a living hinge means as a pivotal connection. Additionally, the outer members (20 and 30, respectively) may be made of 14 gauge steel and the pivotal connection of the outer members may comprise a set of four concentric holes, one in each of the respective side walls (24 and 34, respectively) of the nested outer members (20 and 30, respectively) and two nut 56 and bolt 55 combinations positioned there through and pivotally connecting together the adjacent side walls (24 and 34, respectively) of first and second outer members respectively.

The apparatus depicted in the drawing shows corner bead 10 to be worked having an included angle between two relatively disposed wings 12 of the elongated corner bead is 90° and a spreader means 50 proportioned to displace the disposed wings 12 of the corner bead 10 to a position in which the included angle between the wings 12 is increased to 135° when the first outer member 20 and the second outer member 30 are moved to a lowered position, as shown in FIGS. 4 and 6, and the apparatus and corner bead 10 are longitudinally moved relative to each other.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

What I claim is:

1. A method of increasing the included angle between two relatively disposed wings of an elongated article having a longitudinal apex, such as a corner bead, which comprises:

a. arranging pivotally connected first and second outer members, said first outer member, having an upper and a lower surface, with a guide means centrally disposed longitudinally on said lower surface, and having a forward end in opposition longitudinally to a remote end which is pivotally connected to the second outer member, said second outer member having an upper and a lower surface, with a spreader means centrally disposed longitudinally on said upper surface, and having a forward end in opposition longitudinally to a remote end which is pivotally connected to the first outer member, to have the lower surface of the first outer member facing the upper surface of the second outer member;

b. raising the forward end of the first outer member pivotally relative to the forward end of the second outer member to a distance between the guide means and the spreader means which permits easy reception of the article;

c. introducing a leading end of the article longitudinally through an end opening of the outer members between the guide means and the spreader means;

d. lowering the forward end of the first outer member pivotally relative to the forward end of the second outer member to permit the guide means to slidably engage a longitudinal portion of the apex of the article and the spreader means to transversely slidably engage a longitudinal section of each of the disposed wings of said article along the surfaces thereof bordering the included angle between said wings at a spaced distance from the apex, e. moving the article slidably through the guide means and the spreader means longitudinally to increase the included angle between the wings of the article.

2. A method of increasing the included angle between two relatively disposed wings, each of which is provided with a plurality of pre-punched holes extending along its entire length, of an elongated article having a longitudinal apex, such as a corner bead, which comprises:

a. arranging pivotally connected first and second outer members, said first outer member, having an upper and a lower surface, with a guide means centrally disposed longitudinally on said lower surface, and having a forward end in opposition longitudinally to a remote end which is pivotally connected to the second outer member, said second outer member having an upper and a lower surface, with a spreader means centrally disposed longitudinally on said upper surface, and having a forward end in opposition longitudinally to a remote end which is pivotally connected to the first outer member, to have the lower surface of the first outer member facing the upper surface of the second outer member;

b. raising the forward end of the first outer member pivotally relative to the forward end of the second outer member to a distance between the guide means and the spreader means which permits easy reception of the article;

c. introducing a leading end of the article longitudinally through an end opening of the outer members between the guide means and the spreader means and exposing from the opposite end of said outer members a portion of the article having at least one hole disposed thereon;

d. lowering the forward end of the first outer member pivotally relative to the forward end of the second outer member to permit the guide means to slidably engage a longitudinal portion of the apex of the article and the spreader means to transversely slidably engage a longitudinal section of each of the disposed wings of said article along the surfaces thereof bordering the included angle between said wings at a spaced distance from the apex;

e. securing an exposed hole of a wing of the leading end of the article to a stationary hook: and f. moving slidably the outer members longitudinally along the length of said article to increase the included angle between the wings of the article.

3. A portable hand tool for increasing the included angle between two relatively disposed wings of an elongated article having a longitudinal apex, such as a corner bead, comprising:

f. first and second outer members, each having an upper and a lower surface and a forward end in opposition longitudinally to a remote end;

g. the first outer member being arranged and adapted to have its lower surface facing the upper surface of the second outer member;

h. the first outer member having a guide means centrally disposed longitudinally along its lower surface;

i. the second outer member having a spreader means centrally disposed longitudinally along its upper surface;

j. the first outer member having a forward end thereof pivotally connected to a forward end of the second outer member for movement between a raised position, in which the distance between the guide means and the spreader means permits easy reception of a leading end of an elongated article having two relatively disposed wings, to a lowered position, in which the lower surface of the first outer member is substantially parallel to the upper surface of the second outer member and in which therebetween the guide means slidably engage a longitudinal portion of the apex of the article in opposition to the spreader means which is arranged and adapted to transversely slidably engage a longitudinal section of each of the disposed wings of said article along the surfaces thereof bordering the included angle between said wings at a spaced distance from the apex, whereby, the included angle between the wings of the article may be increased by the introduction of a leading end of an article longitudinally through an end opening of the outer members in a raised position between the guide means and the spreader means, by movement of the outer members from a raised position to a lowered position, and by relative movement of the article slidably passing through said tool longitudinally and of the tool slidably passing along the length of said article; and wherein k. the second outer member is generally a U-shaped channel having two side walls extending upwardly from the upper surface thereof and having end openings, and having side wall height which exceeds the height of an article positioned with its apex upwardly directed, and having a width which exceeds the widest width of wing span of the article and having a length proportioned to receive a longitudinal section of the article;

l. the first outer member is generally a U-shaped channel having two side walls extending downwardly from the lower surface thereof and having end openings, and having a width which exceeds the width of the second outer member and having a length proportioned to receive the second outer member;

m. the second outer member being arranged and adapted to be substantially nested within the first outer member, in which the forward end thereof is pivotally connected to a forward end of the second outer member;

n. the guide means is generally a U-shaped channel having an upper surface and a lower surface and two side walls extending downwardly from the lower surface and having end openings, and having a width which exceeds the width of the apex of the article, and having a height of its downwardly extending side walls which does not exceed the height of the apex of the article, and having a length which does not exceed the length of the first outer member; and o. the spreader means is generally an elongated projection having a width not exceeding the wing span of an article having an included angle of 90°, and having a height not exceeding the height of the side walls of the second outer member less the height of the apex of the article and proportioned to transversely engage and displace the disposed wings of said article when the first outer member and the second outer member are moved to a lowered position.

4. The portable hand tool of claim 3 in which the spreader means comprises a downwardly opening U-shaped channel.

5. The portable hand tool of claim 3 in which the spreader means comprises a rectangular tube.

6. The portable hand tool of claim 3 further comprising a stopping means to limit the movement of the remote end of the first outer member relative to the remote end of the second outer member.

7. The portable hand tool of claim 6 in which the stopping means comprises an inward projection extending from an inner surface of a side wall of the first outer member proximate to the remote end thereof arranged and adapted to move within a recess in an adjacent side all of the second outer member as said members are moved between a raised and a lowered position.

8. The portable hand tool of claim 3 in which the outer members are made of 14 gauge steel and in which the pivotal connection of the outer members comprises a set of four concentric holes, one in each of the respective side walls of the nested outer members and two nut and bolt combinations positioned there through and pivotally connecting together the adjacent side walls of first and second outer members respectively.

9. The portable hand tool of claim 3 in which the included angle between two relatively disposed wings of the elongated article is 90 degrees and in which spreader means is proportioned to displace the disposed wings of the article to a position in which the included angle between said wings is increased to 135 degrees when the first outer member and the second outer member are moved to a lowered position and the tool and article are longitudinally moved relative to each other.

10. The portable hand tool of claim 4 in which the included angle between two relatively disposed wings of the elongated article is 90 degrees and in which spreader means is proportioned to displace the disposed wings of the article to a position ion which the included angle between said wings is increased to 135 degrees when the first outer member and the second outer member are moved to a lowered position and the tool and article are longitudinally moved relative to each other.

11. The portable hand tool of claim 5 in which the included angle between two relatively disposed wings of the elongated article is 90 degrees and in which spreader means is proportioned to displace the disposed wings of the article to a position in which the included angle between said wings is increased to 135 degrees when the first outer member and the second outer member are moved to a lowered position and the tool and article are longitudinally moved relative to each other.

12. The portable hand tool of claim 6 in which the included angle between two relatively disposed wings of the elongated article is 90 degrees and in which spreader means is proportioned to displace the disposed wings of the article to a position in which the included angle between said wings is increased to 135 degrees when the first outer member and the second outer member are moved to a lowered position and the tool and article are longitudinally moved relative to each other.

13. The portable hand tool of claim 7 in which the included angle between two relatively disposed wings of the elongated article is 90 degrees and in which spreader means is proportioned to displace the disposed wings of the article to a position in which the included angle between said wings is increased to 135 degrees when the first outer member and the second outer member are moved to a lowered position and the tool and article are longitudinally moved relative to each other.

14. The portable hand tool of claim 8 in which the included angle between two relatively disposed wings of the elongated article is 90 degrees and in which spreader means is proportioned to displace the disposed wings of the article to a position in which the included angle between said wings is increased to 135 degrees when the first outer member and the second outer member are moved to a lowered position and the tool and article are longitudinally moved relative to each other.

* * * * *